United States Patent [19]

Ross

[11] 4,069,802

[45] Jan. 24, 1978

[54] COLD STARTING DEVICES

[75] Inventor: Gary Ernest Donald Ross, Stanmore, England

[73] Assignee: The Zenith Carburetter Company Limited, Stanmore, England

[21] Appl. No.: 702,206

[22] Filed: July 2, 1976

Related U.S. Application Data

[63] Continuation-in-part of Ser. No. 505,227, Sept. 12, 1974, Pat. No. 3,967,610.

[30] Foreign Application Priority Data

| | | |
|---|---|---|
| Sept. 12, 1973 | United Kingdom | 42888/73 |
| Sept. 11, 1974 | United Kingdom | 39665/74 |
| Mar. 9, 1976 | United Kingdom | 9387/76 |

[51] Int. Cl.[2] ..... F02N 17/00

[52] U.S. Cl. ..... 123/179 G; 123/119 F; 261/39 D

[58] Field of Search ..... 123/119 F, 179 G; 261/39 D, 50 A, 44 R, 63, 64 C

[56] References Cited

U.S. PATENT DOCUMENTS

| | | | |
|---|---|---|---|
| 2,074,471 | 3/1937 | Hulley et al. | 123/119 F |
| 2,264,996 | 12/1941 | Messinger, Jr. | 123/119 F |
| 2,264,997 | 12/1941 | Messinger, Jr. | 123/119 F |
| 2,868,185 | 1/1959 | Bellicardi | 123/180 T |
| 3,059,909 | 10/1962 | Wise | 261/39 D |
| 3,493,217 | 3/1970 | Farley | 261/50 A |
| 3,877,448 | 1/1974 | Schnid | 261/39 D |

*Primary Examiner*—Charles J. Myhre
*Assistant Examiner*—David D. Reynolds
*Attorney, Agent, or Firm*—Stevens, Davis, Miller & Mosher

[57] ABSTRACT

An internal combustion engine cold start device has an air valve which co-operates with a valve seat to vary the cross-sectional area of a gas supply passage upstream of a plug valve in the passage. The air valve is urged towards the valve seat by a coil spring and a plunger, which is urged towards a stop by another coil spring, provides a resilient abutment for the air valve which limits movement of the air valve away from its valve seat. The plunger is urged away from its stop, against the action of its coil spring, by manifold depression which is fed to the plunger bore by a short straight pipe.

13 Claims, 3 Drawing Figures

37
68
33
103
69
79
62
80
82
78
88
17
34
63A
81
29
60
100
86
24
94
92
93
99
61
97
65
64
98
18
26
63B
25
27
58A
58
12
10
11

COLD STARTING DEVICES

This application is a continuation-in-part of U.S. Ser. No. 505,227 filed Sept. 12, 1974 now U.S. Pat. No. 3,967,610.

This invention relates to cold start devices for internal combustion engines, the cold start devices being designed so that the constitution of fuel/air mixture supplied to the engine is changed firstly at the end of the engine cranking period, when the engine begins to run under its own power, whereafter it can be changed progressively as the engine warms up to its normal operating temperature at which there is no further need for extra fuel or air to be supplied to the engine by a cold start device.

Usually a cold start device of the kind referred to comprises an air supply passage which has one end for connection to the inlet manifold of the engine so that air can be drawn through that passage by engine suction, fuel supply means from which fuel can be drawn for mixture with air which flows through that passage, a throttle valve for metering the supply of fuel/air mixture, gas, to the engine and an air valve upstream of the throttle valve, the air valve co-operating with an associated valve seat to vary the area of the part of the passage upstream of the throttle valve through which air is drawn by engine suction and thereby to control the depression that is established within that part of the passage between the air valve and the throttle valve and that serves as the fuel demand signal that draws fuel into the passage from the fuel supply means.

It is thought that the optimum air/fuel ratio requirements of an internal combustion engine vary with the performance of that engine, for example, with changes in the loading of the engine. An object of this invention is to arrange a cold start device so that the fuel demand signal that is established in the device when the device is in use is varied in accordance with variations in the performance of an associated internal combustion engine.

A cold start device for an internal combustion engine in which this invention is embodied comprises a body in which an air supply passage is formed. One end of the air supply passage is adapted for connection to the inlet manifold of the engine. There is an automatic throttle valve in the air supply passage which tends to be urged by engine suction to close the air supply passage and minimise air flow through that passage to the engine. Means are provided for varying the effective cross-sectional area of a part of the air supply passage upstream of the throttle valve so as to control the depression established between the throttle valve and that part of the passage. A fuel control valve allows fuel to be drawn from a fuel supply system into the air supply passage between the throttle valve and the aforesaid part of the passage by the action of a depression which is established in the air supply passage by engine suction. Such a depression acts upon the area varying means and tends to enlarge the area of said passage part. The effect of such a depression upon the area varying means is opposed by yieldable biassing means of which at least a part is associated with a movable wall which has a surface which is exposed to the pressure that is existent in a space which is for connection to the inlet manifold of the engine, the action of manifold depression upon the movable wall surface tending to reduce the biassing effect of the yieldable biassing means upon the area varying means.

It has been proposed that the said space should comprise that part of the air supply passage that is downstream of the throttle valve. However in certain vehicle engine installations, the flow path from that part of the air supply passage downstream of the throttle valve to the engine inlet manifold is long and tortuous and may be sufficiently so that the influence of pipe losses is significant with the result that the depression that acts in said space is significantly smaller than the engine inlet manifold depression. We have found that, where a cold start device according to this invention is included in such an engine installation and the area varying means include an air valve which is fixed to the end of a said plunger remote from the said movable wall surface, the plunger being engaged slidably in a bore in the body of the device which communicates with the air supply passage downstream of the throttle valve so that the said movable wall surface is exposed to that part of the air supply passage, the depression that acts upon the said movable wall surface under engine idling conditions when the engine is cold and the ambient temperature conditions are extremely cold, near arctic conditions is insufficient for satisfactory operation of the cold start device. Accordingly, we prefer that said space is formed in said bore and that conduit means are provided for connecting said bore to the inlet manifold of the internal combustion engine when the device is installed on the internal combustion engine, the conduit means being selected so that the influence of pipe losses upon air flow from said bore to the inlet manifold is less than the influence of pipe losses upon fluid flow from that part of the air supply passage downstream of the throttle valve to the inlet manifold so that the depression that acts within said bore upon the movable wall surface is greater than the depression that is established within that part of the air supply passage downstream of the throttle valve.

Also we have found that it is preferable to arrange a cold start device according to this invention so that the depression that is established within that part of the air supply passage between said passage part and the throttle valve when the cold start device is installed on an internal combustion engine, is maintained at or above a minimum in order to avoid problems that can follow initial reduction of the depression downstream of said throttle valve that accompanies initial opening of the driver operable engine throttle valve when the temperature of the engine is lower than the normal operating temperature, that is to say either under cold engine idling conditions or under the so-called "engine overrun" conditions when the engine is acting as a brake and the driver operable engine throttle valve is closed. To this end we prefer to provide a cold start device according to this invention in which said area varying means comprise an air valve and a co-operating valve seat positioned within said air supply passage upstream of said throttling means, and said movable wall comprises a plunger which is engaged for sliding movement within a bore in the body, the bore being aligned substantially co-axially with the air valve and the movable wall surface comprising the surface of the plunger at the end of the plunger remote from the air valve, wherein said plunger and the air valve are unconnected and part of said yieldable biassing means urge said plunger towards said air valve, the remainder of said yieldable biassing means acting directly upon said air valve to urge it towards said valve seat, the arrangement being such that said plunger exerts a thrust upon said air valve to oppose the action of the depression that is established within that part of the auxiliary air supply passage between the throttle valve and the air valve seat upon the air valve only when the load applied to the plunger by the said part of the yieldable biassing means that acts directly upon the plunger exceeds the suction force upon that plunger due to the action of engine suction upon said movable wall surface of the plunger. Conveniently said part of the yieldable biassing means that acts upon said plunger comprises a coil spring which is located within said bore and which reacts against an abutment formed by the body within the bore. Preferably the air valve is guided for rectilinear movement coaxially with said plunger by the interengagement of a guide stem which is carried by one of them with a correspondingly shaped guide cavity which is formed in the other. The guide stem may be cylindrical, be carried coaxially by the air valve and be engaged for sliding movement within an elongate axially-extending cylindrical cavity which is formed in the plunger, the cavity being closed at one end and having a mouth at its other end which is at the end of the plunger remote from said movable wall surface.

A characteristic of such a cold start device is that the proportion of fuel in the air/fuel mixture that is supplied by the cold start device to the engine during the acceleration mode of the engine tends to increase as the engine warms up to its normal operating temperature at which there is no further need for extra fuel or air to be supplied to the engine by a cold start device. It is desirable to reduce the tendency for the air/fuel mixture supplied by such a cold start device during the acceleration mode of the associated engine to contain a higher proportion of fuel when the temperature of the engine approaches that at which there is no further need for extra fuel or air to be supplied to the engine by the cold start device, than when the engine is cold, if such a reduction can be achieved conveniently. A stop which prevents the plunger being urged by said part of the yieldable biassing means into abutment with the air valve when the air valve is seated may be provided in order to counter the tendency for the air/fuel mixture supplied by such a cold start device during the acceleration mode of the associated engine to contain a higher proportion of fuel when the temperature of the engine approaches that at which there is no further need for extra fuel or air to be supplied to the engine by the cold start device, the stop ensuring that the minimum clearance between the plunger and the valve seat is sufficient for the air valve to move between the valve seat and the plunger to modulate air flow into that part of the air supply passage between the valve seat and the throttle valve and thereby to control the depression that is established within that part of the air supply passage without the air valve being drawn by that depression into contact with the plunger with sufficient force to displace the plunger against the action of said yieldable biassing means part once the engine has warmed up to a predetermined temperature below the normal operating temperature at which there is no further need for extra fuel or air to be supplied to the engine by a cold start device.

Preferably the plunger is engaged slidably in a bore in the body of the cold start device and the stop is formed at the end of that bore which is nearer to the valve seat, the stop projecting radially inwardly into the bore. Conveniently the stop comprises a radially-inwardly-directed annular flange. The plunger may be stepped, a larger diameter portion of the plunger being engaged slidably within the bore and a smaller diameter portion of the plunger projecting through the aperture formed by the radially-inwardly directed annular flange.

The inlet manifold of the engine can become flooded with liquid fuel if air is not drawn into that part of the air supply passage that is between the air valve seat and the throttle valve whilst the engine is being cranked for starting with consequent failure of the engine to run under its own power. Although the loading of that part of the yieldable biassing means that acts directly upon the air valve could be selected so that the air valve can be unseated by the suction exerted by the engine when it is cranked for starting, it is difficult to prevent the air valve being held seated by the combined action of the two yieldable biassing means parts when the engine is very cold and the suction exerted by the engine is minimal because the thrust that acts to oppose the action of the yieldable biassing means part that acts upon the plunger is minimal when such conditions prevail.

Another object of this invention is to minimise the likelihood of the inlet manifold of the engine being flooded with liquid fuel when the engine is very cold. In order to achieve this object I propose to provide an auxiliary air supply passage which communicates with that part of the air supply passage that is between the air valve seat and the throttle valve and which is dimensioned so as to enable sufficient air to be drawn through it into said passage part by engine suction, whilst the engine is being cranked, for the resultant air/fuel mixture to be such as will enable the engine to begin to run under its own power.

One embodiment of this invention will be described now by way of example with reference to the accompanying drawings, of which:

Figure 2:
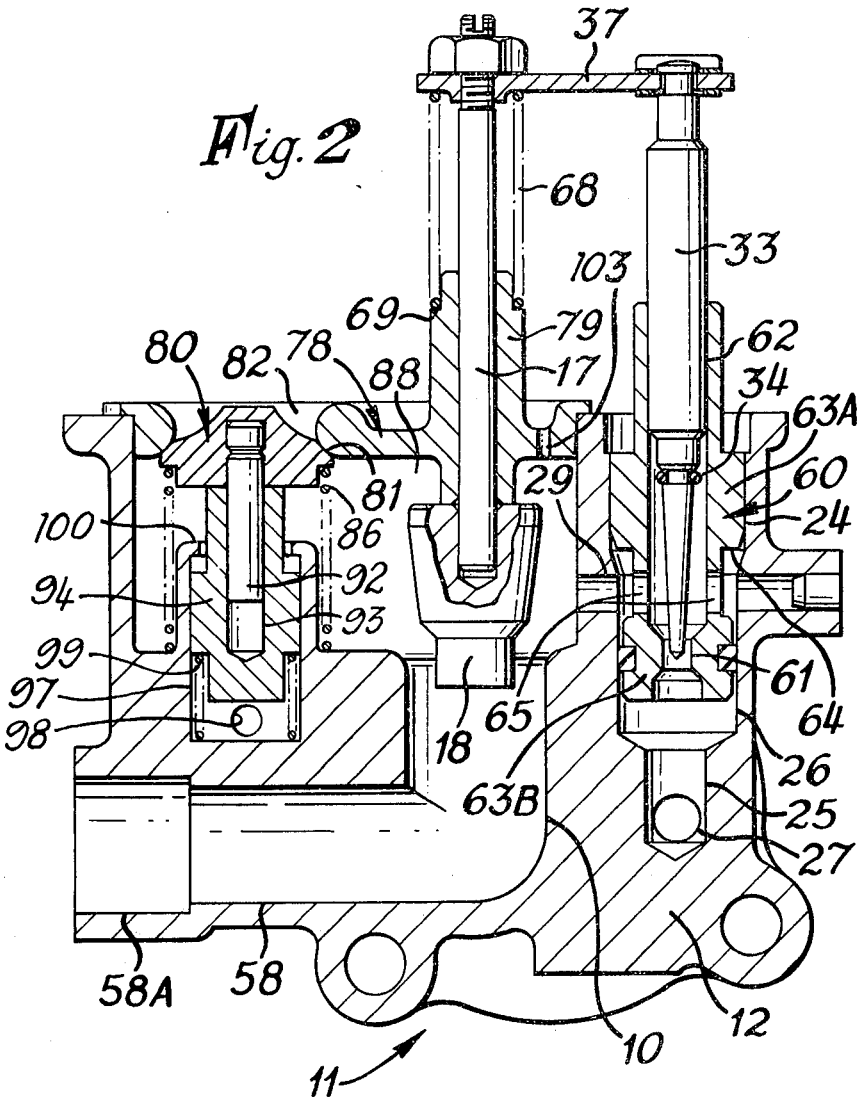
FIG. 2 is a section on the line II—II of FIG. 1.
Figure 3:
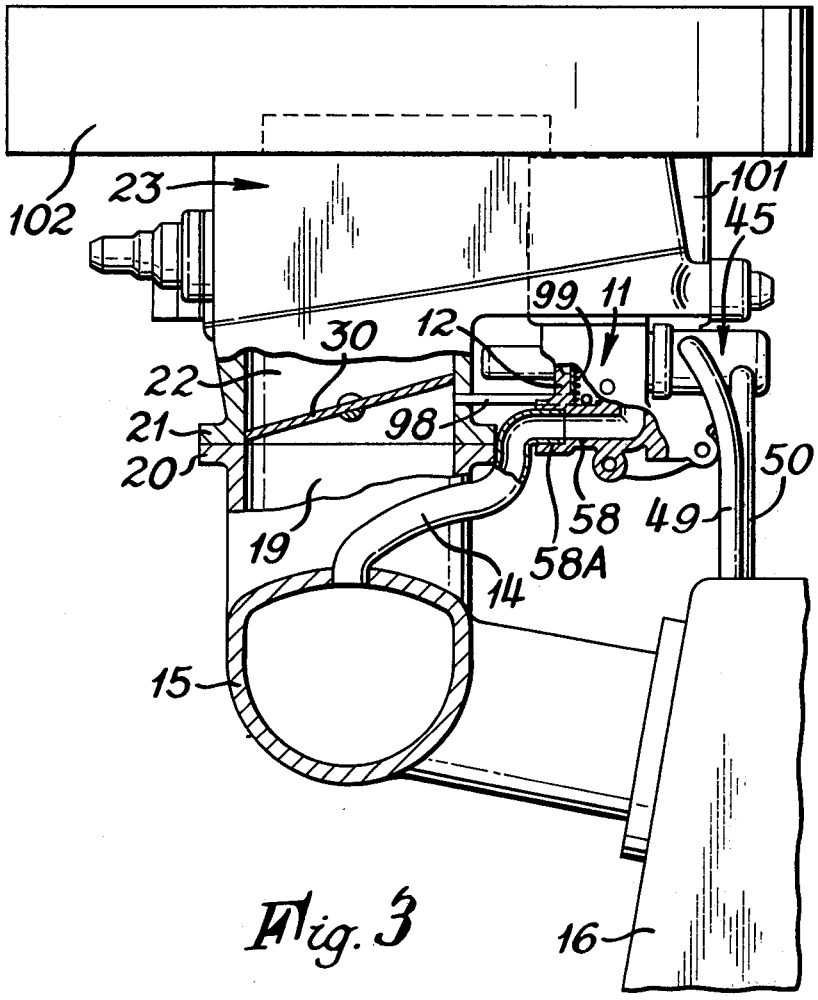
FIG. 3 is a partially sectioned illustration of part of an internal combustion engine installation for a vehicle which includes the automatic cold start device shown in FIGS. 1 and 2.

The fully automatic cold start device 11, which is illustrated in the drawings, is included in an internal combustion engine installation for a motor vehicle which includes a twin carburetter air/fuel induction system. The engine inlet manifold is a casting which comprises a pair of inlet branches 19, a balance pipe 15, which interconnects the inlet branches 19, and a number of outlet branches one for each cylinder of the engine 16, by which the balance pipe 15 is connected to each cylinder of the engine 16. Only one of the two carburetters is shown in the drawings, that carburetter being the carburetter 23 that is shown in FIG. 3 and upon which the cold start device 11 is mounted. FIG. 3 is a transverse section through the balance pipe 15 with part of the carburetter 23, the respective inlet branch 19 and the cold start device 11 shown in section for convenience. The fully automatic cold start device 11 comprises a body 12 which has a through passage formed in it. FIG. 2 shows that the through passage comprises a medial bore portion 10 which connects a chamber 88 to a downstream bore portion 58 which runs at right angles to the medial bore portion 10. The outer end of the downstream bore portion 58 is rebated at 58A and, as can be seen in FIG. 3, receives the outer end of a connector pipe 14 which has its other end connected to the balance pipe 15. The two carburetters are downdraught carburetters. The downstream end 21 of the induction passage 22 of the carburetter 23 is bolted to the flanged upstream end 20 of the respective inlet branch 19 and the other carburetter is similarly connected to the other inlet branch of the inlet manifold casting. The driver operable throttle valve of each carburetter is mounted in the usual manner in the induction passage of that carburetter and the two throttle valves are coupled together so that they function together as the main throttle valve of the engine 16. The throttle valve 30 of the carburetter 23 is shown closed in FIG. 3.

FIG. 2 shows that the chamber 88 of the cold start device 11 is closed at its upstream end by a closure plate 78 which has an aperture 82 formed in it. The aperture 82 is displaced laterally with respect to the axis of the medial bore portion 10 in the direction in which the downstream bore portion 58 runs from that medial bore portion 10.

A profiled plug valve 18 co-operates with the orifice, which is defined by the upstream end of the medial bore portion 10 at the junction of that medial bore portion 10 with the chamber 88, in order to control gas flow from the chamber 88 to the medial bore portion 10. The plug valve 18 is carried by a rod 17 which is guided for rectilinear movement along its axis by being engaged slidably within a tubular guide 79 which is integral with the closure plate 78. A hole 103 is formed in the closure plate 78, the tubular guide 79 extending between the hole 103 and the aperture 82.

A rectilinearly movable air valve 80 co-operates with a valve seat 81 to close the aperture 82. The air valve 80 has a coaxial cylindrical guide stem 92 which is engaged for sliding movement within a closed ended bore 93 which is formed coaxially in a plunger 94 which is not connected to the air valve 80. The plunger 94 is stepped having a central portion which is engaged for sliding movement within a blind bore 97 which is formed in the body 12 coaxially with the annular valve seat 81 and which has its mouth in the wall of the chamber 88, and smaller diameter end portions at each end. An inwardly directed radial flange 100 is formed by the body 12 at the mouth of the blind bore 97. The smaller diameter end portion of the plunger 94 that is nearer to the air valve 80 projects through the aperture formed by the radial flange 100. The closed inner end portion of the blind bore 97 is connected to the induction passage 22 of the carburetter 23 just downstream of the throttle valve 30 by a short straight pipe 98. A coil spring 99 reacts against the closed end wall of the blind bore 97 and urges the plunger 94 into abutment with the air valve 80 so that there is a space between the plunger 94 and the closed end of the blind bore 97. A coil spring 86 which acts directly upon the air valve 80 and urges it towards the valve seat 81 reacts against the body 12 around the mouth of the blind bore 97. There is a clearance between the larger diameter central portion of the plunger 94 and the flange 100 when the air valve 80 is seated and the plunger 94 abuts the air valve 80.

The axes of the plunger 94, the guide stem 92 and the blind bore 97 are parallel to the axes of the plug valve rod 17 and the medial bore portion 10, and are coincident with the axes of the air valve 80 and the annular valve seat 81. Normally the air valve 80 controls communication between the chamber 88 and an enclosure defined between the body 12 and a cup-shaped cover 101 of sheet material which has an inlet port for connection to the outlet of an air cleaner 102. The cup-shaped cover 101 has been omitted from FIG. 2 for convenience.

Another through passage, which is formed within the body 12, has a stepped main bore portion which is substantially parallel with the axes of the plug valve support rod 17 and the medial bore portion 10, and a laterally extending end bore portion 27 which is connected to the fuel float chamber of the carburetter 23. The largest diameter bore portion 62 is in direct communication with the enclosure defined between the body 12 and the cup-shaped cover 101. The smallest diameter bore portion 25 of the stepped main bore portion is separated from the largest diameter bore portion 24 by a medial diameter bore portion 26 and communicates directly with the said laterally extending bore portion 27. The medial diameter bore portion 26 communicates with the chamber 88 via a passage 29 in the body 12 and may communicate with the enclosure that is defined between the body 12 and the cover 101 by a passage in the body 12 which would include a restriction which serves as an air metering orifice.

A tubular component 60 is fitted into the stepped main bore portion of the through passage and has a stepped through bore. The smaller diameter portion 61 of the stepped through bore serves as a fuel metering orifice. A cylindrical member 33, which carries a profiled fuel metering needle, slides within the larger diameter portion 62 of the stepped through bore. The outer cylindrical surface of the tubular component 60 is stepped and comprises a larger diameter cylindrical portion 63A, which is engaged in a fluid-tight manner within the larger diameter bore portion 24 of the stepped main bore portion of the through passage within which the tubular component 60 is housed, and a smaller diameter cylindrical portion 63B which is engaged in a fluid-tight manner within the medial diameter bore portion 26 of the said stepped main bore portion. An annular recess 64 is formed within the largest diameter bore portion 24 by that part of the tubular component 60 which is located in that bore portion 24 and which separates the two cylindrical portions 63A and 63B. The passage 29 communicates with the annular recess 64. Radial passages 65 place the annular recess 64 in communication with the stepped through bore of the tubular component 60 immediately downstream of the fuel metering orifice 61.

The profiled needle carried by the cylindrical member 33 projects through the fuel metering orifice 61 and carries an annular sealing ring 34 at its largest diameter end which is the end that is attached to the cylindrical member 33.

The end of the cylindrical member 33 remote from the profiled needle is coupled to the plug valve support rod 17 by an arm 37 which is fixed at one end to the rod 17 and which extends laterally from it. The fuel metering needle cylindrical support member 33 is connected to the arm 37 with a clearance between itself and the arm 37 so that it can move laterally relative to the arm 37 whilst being retained against axial movement relative to the arm 37. An annular shoulder 69 is formed on the tubular guide 79. A coil spring 68 reacts gainst the shoulder 69, surrounds the rod 17 coaxially and is engaged at its end remote from the annular shoulder 69 with the arm 37 so that the plug valve 18 and the fuel metering needle, which are coupled together and guided for rectilinear movement together along parallel paths, are urged by the coil spring 68 into the respective positions in which the effective cross-sectional area of their associated orifices is at its greatest.

Figure 1:
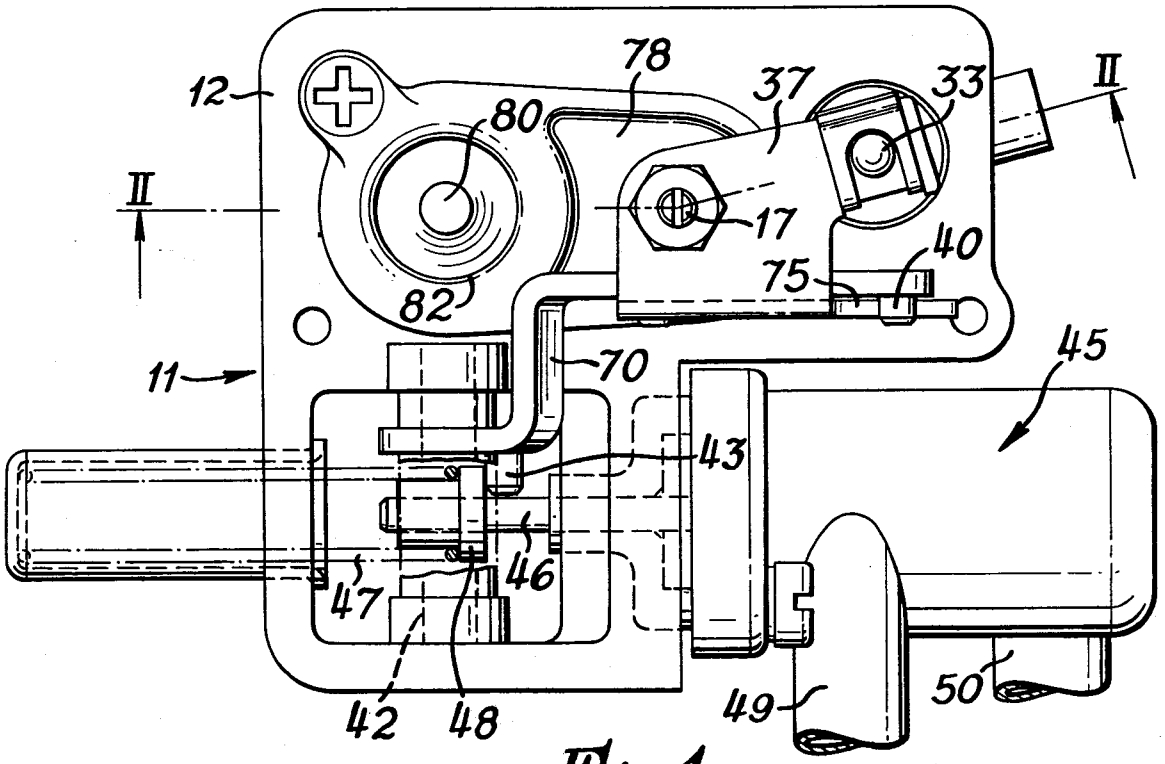
FIG. 1 is a plan view of an automatic cold start device in which this invention is embodied, the various parts being shown in the positions they adopt when the engine is cold and not running.

FIG. 1 shows a beam 70 which is mounted pivotally on a hinge pin 42. The beam 70 carries a peg 40 at its end nearer the rod 17, another peg between the peg 40 and the hinge pin 42 and a third peg 43 at its other end. The said other peg is not shown in FIG. 1 being concealed by the arm 37.

A temperature sensitive capsule is housed within a water jacket 45 which is mounted on the body 12. The capsule is filled with wax or other suitable substance having a high thermal expansion. The arrangement is such that, with increase in temperature, the wax or other substance expands and moves a rod 46 along its length against the action of a coil spring 47. The axes of the rod 46 and spring 47 are normal to the axes of the plug valve rod 17 and the fuel metering needle. The rod 46 carries an annular flange 48. The peg 43 extends between the flange 48 and the capsule 45, the axes of the peg 43 and the rod 46 being mutually perpendicular. A torsion spring (not shown) reacts against the body 12 and acts on the beam 70 so that the peg 43 is held in contact with the flange 48 and the peg 40 is in contact with the outer limb of a cranked arm 75 at the same time, the cranked arm 75 being fixed to the arm 37.

The temperature sensitive capsule is sensitive to engine water temperature, the pipes 49 and 50 of the water jacket 45 being connected into the engine cooling system. However the temperature sensitive capsule may be arranged so as to be sensitive to an electric heater or any other suitable means by which the angular position of the beam 70 can be related to the temperature of the engine.

When the engine 16 is cold, the temperature sensitive capsule allows the spring 47 to hold the rod 46 in the position in which the flange 48 is nearest to the capsule 45. Thus, due to the inter-engagement of the peg 43 and the flange 48, the beam 70 is held against the action of the torsion spring in the position in which the peg 40 is furthest from the body 12, the torsion spring being extended. The coil spring 68 acts through the arm 37 to hold the arm 37 in its position furthest from the body 12 so that the outer limb of the cranked arm 75 is in contact with the peg 40. Thus the plug valve 18 is spaced from the associated orifice. The said other peg serves to limit movement of the arm 37 towards the body 12 and thus to stop movement of the plug valve 18 towards the associated orifice. The air valve 80 is seated upon the associated valve seat 81 by the action of the coil spring 86. The plunger 94 is held against the air valve 80 by the action of the coil spring 99.

When the cold engine 16 is cranked for starting, the parts remain in the position just described. Suction exerted by the engine 16 causes air to be drawn through the hole 103 and a metered quantity of fuel to be drawn into the chamber 88 of the through passage through the fuel metering orifice 61 and the passage 29. Fuel is drawn through the fuel metering orifice 61 at a high rate because the profiled needle is withdrawn and the effective area of the fuel metering orifice is at its greatest. The dimensions of the hole 103 are such that sufficient air is drawn through it into the chamber 88 for mixture with the fuel that is drawn through the fuel metering orifice 61 to form a mixture of air and fuel which is suitable for cranking purposes.

When the cold engine 16 begins to run under its own power, increased suction exerted by the engine 16 opposes the action upon the air valve 80 of the biassing springs 86 and 99 and acts to unseat the air valve 80 from the co-operating valve seat 81 and to urge the plug valve 18 towards its associated orifice. Movement of the plug valve 18, and movement of the profiled needle with it, is limited by the said other peg which is abutted by the abutment which projects from the arm 37. Such suction also tends to move the plunger 94 away from the air valve 80. Hence, when the carburetter throttle valves 30 are closed so that the depression in the inlet manifold casting is high, the force on the plunger 94 due to engine suction exceeds the loading of the coil spring 99, the coil spring 99 is contracted and the plunger 94 is moved away from the air valve 80 so that the position of the air valve 80 is determined solely by the action of the coil spring 86 and the depression in the chamber 88, with the result that that depression is maintained at or below a maximum depression which is dependent upon the loading of the coil spring 86 and which is the depression that is required to unseat the air valve 80. When the carburetter throttle valves 30 are opened to increase the speed of the engine 16, the depression in the inlet manifold casting is reduced with the result that the force on the plunger 94 due to engine suction is reduced also. If the depression in the inlet manifold casting is reduced sufficiently, the loading of the coil spring 99 will exceed the force on the plunger 94 due to engine suction. Hence the coil spring 99 will extend and the plunger 94 will be urged towards the air valve 80, the plunger 94 imparting a thrust to the air valve 80 that urges the air valve 80 towards its valve seat 81 if it strikes the air valve 80. Such a thrust, together with the action of the coil spring 86, opposes the action upon the air valve 80 of the depression established in the chamber 88 and urges the air valve 80 towards the valve seat 81 to reduce the effective area of the aperture 82 and effect an increase in the depression within the chamber 88. The ratio of fuel to air that is drawn through the orifice that is associated with the plug valve 18 is increased by the combined effects of the reduction in the effective area of the aperture 82 and the increase in the depression within the chamber 88. The force which is imparted by the plunger 94 to the air valve 80 to urge that air valve 80 towards the valve seat 81 comprises the difference between the loading of the coil spring 99 and the force on the plunger 94 due to engine suction. The cross-sectional area of the larger diameter portion of the plunger 94, the effective area of the air valve 80 which is exposed to the depression that is established in the chamber 88, and the loading of the coil springs 86 and 99 are selected so that the depression within the chamber 88 is a function of the inverse of the depression that exists in the downstream bore portion 58 when the engine 16 is running and the air valve 80 and the plunger 94 move together as one.

As the temperature of the engine 16 increases, the temperature sensitive capsule urges the rod 46 against the action of the coil spring 47 thus allowing the beam 70 to be rotated by the action of the torsion spring in the direction which moves the peg 40 and the said other peg towards the body of the device. Such movement of the said other peg allows following movement of the arm 37 due to the action of engine suction on the plug valve member 18, so that the plug valve 18 is moved to reduce the effective area of the associated orifice and thus to reduce the mass flow of air through the through passage, and the profiled needle is moved with it to reduce the effective area of the fuel metering orifice. This continues until the temperature of the engine 16 has increased to the normal working temperature whereupon the plug valve 18 reaches the end of its stroke remote from the closure plate 78 and the associated orifice in the through passage is closed. Also the sealing ring 34 carried by the profiled needle seats upon the shoulder defined within the stepped through bore of the tubular component 60 to close the fuel metering orifice 61.

It will be understood that the rate of flow of fuel through the fuel metering orifice is dependent upon the effective area of the fuel metering orifice and thus is altered in accordance with changes in engine temperature by the profiled needle which is allowed to move with changes in engine temperature. Likewise the rate of flow of fuel/air mixture through the orifice associated with the profiled plug valve 18 is altered in accordance with the changes in engine temperature by the profiled plug valve 18 which is allowed to move with changes in engine temperature. Conveniently the profile of the plug valve 18 is selected so that the idling speed of the engine 16 is maintained constant throughout the period required for the engine to warm up to its normal operating temperature.

The degree of suction exerted by the engine 16 upon the plug valve 18 is reduced if the carburetter throttle valves 30 are opened for vehicle acceleration. Furthermore, if that reduction is sufficient to reduce the force which that suction exerts upon the plug valve 18 to a force which is less than the opposing force exerted by the coil spring 68, the plug valve 18 and the fuel metering needle are moved to increase the effective area of the orifices with which they are associated. Such movement of the plug valve 18 and the fuel metering needle is limited by engagement of the outer limb of the cranked arm 75 with the peg 40.

If the engine 16 stalls or tends to stall because insufficient fuel is supplied to it when it is cold which may follow from the carburetter throttle valves 30 being opened for vehicle acceleration, the resultant reduction in the depression established in the downstream bore portion 58 will be accompanied by movement of the air valve 80 towards the co-operating valve seat 81 under the action of the biassing load exerted thereon by the coil springs 86 and 99, due to the reduction in the counterload exerted upon the plunger 94 by engine suction, so that the depression established in the chamber 88 is increased. Such an increase in the depression established within the chamber 88 constitutes an increase in the fuel demand signal by which fuel is drawn through the fuel metering orifice 61 so that a greater quantity of fuel is supplied to the engine 16 to counteract the tendency of the engine 16 to stall.

The radially-inwardly directed annular flange 100 is provided as an aide to the assembly of the cold start device that has been described above with reference to the drawings. However it may be provided so that it acts as a stop to limit movement of the plunger 94 towards the air valve seat 81, the axial length of the end portion of the plunger 94 that extends from the larger diameter central portion of the plunger 94 towards the air valve 80 being less than the distance between the air valve 80 and the remote surface of the annular flange 100 so that the larger diameter portion of the plunger 94 is held against the annular flange 100 by the action of the coil spring 99 and so that there is a clearance between the air valve 80 and the adjacent face of the plunger 94 when the engine is cold and the air valve 80 is seated upon its valve seat 81. The depression that is established in the chamber 88 when the engine begins to run under its own power is sufficient to move the air valve 80 against the action of the coil spring 86 through a distance which is greater than the distance by which the air valve 80 was spaced from the plunger 94 before the engine was cranked for starting. Hence the plunger 94 will strike the air valve 80 and impart a thrust to the air valve 80 which urges the air valve 80 towards the valve seat 81 if the carburetter throttle valves 30 are opened to increase the speed of the engine when the engine is cold. The radially-inwardly directed annular flange 100 prevents the plunger 94 being urged by the coil spring 99 into contact with the air valve 80 once the temperature of the engine 16 has risen to a predetermined value, when that flange 100 is arranged to act as a stop which limits movement of the plunger 94 towards the valve seat 81. Hence the depression in the chamber 88 cannot be increased above that which is established by the action upon the air valve 80 of the coil spring 86 and the depression in the chamber 88 when the carburetter throttle valves 30 are opened and the temperature of the engine exceeds the predetermined value, whereas that depression is increased by the action of a thrust imparted to the air valve 80 through the plunger 94 by the coil spring 99 when the carburetter throttle valves 30 are opened and the engine 16 is cold and would be so increased when the carburetter throttle valves 30 are opened and the temperature of the engine exceeds the predetermined value if the stop was not provided. Hence the degree by which the proportion of fuel in the mixture of air and fuel that is supplied to the engine by the device 11 is increased when the carburetter throttle valves 30 are opened is greater when the engine 16 is cold than when the temperature of the engine exceeds the predetermined value referred to above if the radially-inwardly directed annular flange 100 is arranged to act as a stop which limits movement of the plunger 94 towards the valve seat 81. The profile of the fuel metering needle may be arranged to provide compensation for the fact that the fuel demand signal cannot be increased by the action of the coil spring 99 once the engine temperature exceeds the predetermined temperature by suitably modifying the metering of fuel supplied.

The depression that is established in the chamber 88 when the carburetter throttle valves 30 are closed decreases with the reduction in the effective area of the throttle valve orifice and the consequent reduction in the mass flow of air through the through passage which accompanies increase in the temperature of the engine. Eventually that depression is insufficient to displace the air valve 80 from its valve seat 81 into contact with the adjacent end of the plunger 94 when the larger diameter portion of the plunger 94 is held against the inwardly directed radial flange 100 by the coil spring 99. The position of the air valve 80 under such conditions is determined solely by the action of the coil spring 86 and the depression in the chamber 88 with the result that that depression is maintained at or below the maximum depression that is determined by the loading of the coil spring 86.

Use of the short straight pipe 98 to connect to the induction passage 22 of the carburetter 23 to the space to which the end surface of the plunger 94 that is remote from the air valve 80 is exposed leads to the depression that is established within the space between the plunger 94 and the closed end wall of the blind bore 97 being greater than the depression in the downstream bore portion 58.

The space to which the face of the plunger 94 is exposed may be connected to the downstream bore portion 58 if desired.

It will be recognised that the dimensions of the air valve 80 and the plunger 94, together with the loading of the coil springs 86 and 99, can be selected so that the depression established in the chamber 88 is maintained substantially constant whilst the engine is running, or is any desired function of the depression in the bore 58 when the engine is running, that is to say either inversely proportional to the depression established in the downstream bore portion 58 or directly proportional to that depression.

The hole 103 in the closure plate 78 may be omitted if the load exerted upon the air valve 80 by the coil spring 86 is sufficiently low for the air valve to be unseated by the suction that is exerted by the engine whilst the engine is being cranked for starting.

An air valve for controlling the depression in a mixing chamber of a cold start device so that that depression is constant or is any desired function of the depression established within the downstream bore portion of the auxiliary air supply passage of that cold start device and which comprises a spring closed valve which is associated with a plunger which has its end remote from the valve exposed to engine suction when the device is installed on an internal combustion engine, is not limited in its application to cold start devices which have a throttle valve which is guided for rectilinear movement, and can be used in a cold start device in combination with any convenient means for supplying extra fuel to the auxiliary air supply passage for mixture with air therein and for metering the flow to the engine of the resultant air/fuel mixture to meet the extra air and fuel requirements of a cold engine.

I claim:

1. A cold start device for an internal combustion engine, the cold start device comprising a body; a gas supply passage formed in the body; one end of the gas supply passage being for connection to the inlet manifold of an internal combustion engine so that gas can be drawn through said gas supply passage by the action of engine suction when the device is installed on an internal combustion engine; a valve for controlling gas flow into said gas supply passage; means upstream of said gas flow controlling valve for varying the supply of air to said gas supply passage so as to control the depression established within the gas supply passage between said varying means and said valve, means resiliently biassing said varying means to a position of minimum air supply, said biassing means acting in opposition to the effect of a depression established within the gas supply passage between said varying means and said valve to increase the air supplied by said varying means; and a fuel valve to control flow of fuel from a fuel supply system to said gas supply passage between said varying means and said valve, said fuel control valve being responsive to a depression in the gas supply passage between said varying means and said valve, wherein the improvement comprises plunger means, at least part of said resilient biassing means acting through said plunger means, means exposing a surface of said plunger means to the pressure at the inlet manifold of an internal combustion engine so that, when the device is installed on an internal combustion engine, the biassing effect of said resilient biassing means upon said air supply varying means is reduced by the thrust due to the action of a depression which is substantially that which is established in the inlet manifold of the engine upon said plunger.

2. A cold start device according to claim 1, wherein said air supply varying means is laterally offset from said valve.

3. A cold start device according to claim 1, further comprising biassing means to bias said valve into an open position when the cold start device is in use, said valve being located so as to tend to be moved by engine suction into a closed position in which it minimizes the flow of gas past it to the engine, and means to guide said valve for rectilinear movement within said gas supply passage between said open and closed positions.

4. A cold start device according to claim 3, further comprising a thermostatically controlled movable stop for limiting movement of said valve towards closed position, means responsive to engine temperature, means connecting said stop to said temperature responsive means so that the permitted movement of said valve is minimized by said stop when the engine is cold and is increased as the engine warms up towards normal operating temperature whereby movement of said valve to closed position is, then permitted.

5. A cold start device according to claim 1, wherein said air supply varying means comprise an air valve and a cooperating valve seat positioned within said air supply passage upstream of said valve, said biassing means tending to seat said air valve upon said valve seat, means mounting said plunger for sliding movement within a bore in the body, the bore being aligned substantially coaxially with the air valve, and the surface of the plunger at the end of the plunger remote from the air valve being exposed to the pressure at the inlet manifold.

6. A cold start device according to claim 5, wherein a space is formed in said bore and the exposing means include conduit means connecting said bore to the inlet manifold of an internal combustion engine, said conduit means being selected so that the influence of pipe losses upon gas flow from said bore to the inlet manifold is less than the influence of pipe losses upon fluid flow from that part of the auxiliary gas supply passage downstream of said valve.

7. A cold start device as claimed in claim 5, wherein said plunger and the air valve of said air supply varying means are separate, part of said biassing means urging said plunger towards said air valve, the remainder of said biassing means acting directly upon said air valve to urge it towards said valve seat.

8. A cold start device according to claim 7, wherein the air valve of said air supply varying means is guided for rectilinear movement coaxially with said plunger by the inter-engagement of a guide stem which is carried by one of them with a correspondingly shaped guide cavity which is formed in the other.

9. A cold start device according to claim 7, wherein the improvement further comprises a stop which prevents the plunger being urged by said biassing means part into abutment with the air valve when the air valve is seated, the stop ensuring that the minimum clearance between the plunger and the valve seat is sufficient for the air valve to move between the valve seat and the plunger to modulate air flow into that part of the gas supply passage between the valve seat and said valve controlling gas flow thereby to control the depression that is established within that part of the gas supply passage without the air valve being drawn by that depression into contact with the plunger with sufficient force to displace the plunger against the action of said biassing means part once the engine has warmed up to a predetermined temperature below the normal operating temperature at which there is no further need for extra fuel or air to be supplied to the engine by a cold start device.

10. A cold start device according to claim 9, wherein the stop is formed at the end of the bore which is nearer to the valve seat, the stop projecting radially inwardly into the bore.

11. A cold start device according to claim 10, wherein the stop comprises a radially-inwardly directed annular flange.

12. A cold start device according to claim 11, wherein the plunger is stepped, a larger diameter portion of the plunger being engaged slidably within the bore and a smaller diameter portion of the plunger projecting through the aperture formed by the radially-inwardly directed annular flange.

13. A cold start device according to claim 7, wherein the improvement further comprises an auxiliary air supply passage which communicates with that part of the gas supply passage that is between the air valve seat and said valve controlling gas flow and which is dimensioned so as to enable sufficient air to be drawn through it into said passage part by engine suction, whilst an engine to which the device is connected is being cranked, for the resultant air/fuel mixture to be such as will enable the engine to begin to run under its own power.

* * * * *